United States Patent [19]

Faciane et al.

[11] Patent Number: 4,654,923

[45] Date of Patent: Apr. 7, 1987

[54] LOTTERY TICKET PROCESSOR

[75] Inventors: Gregory R. Faciane, 201 W. Grand View, Sierra Madre, Calif. 91024; Maxine M. Faciane, 19503 S. Tilman, Carson, Calif. 90746

[73] Assignees: Gregory R. Faciane, Sierra Madre; Maxine M. Faciane; Louis H. Faciane, both of Carson; Ralph G. Faciane, Monterey Park, all of Calif. ; a part interest

[21] Appl. No.: 804,925

[22] Filed: Dec. 5, 1985

[51] Int. Cl.[4] ..... A47L 13/02

[52] U.S. Cl. ..... 15/236 R; 15/236 A; 30/169

[58] Field of Search ..... 30/169; 15/236 R, 236 A, 15/100, 245, 256.6, 104 R

[56] References Cited

U.S. PATENT DOCUMENTS

| | | | |
|---|---|---|---|
| 520,818 | 6/1894 | Bettinger | 15/236 R |
| 1,464,264 | 8/1923 | Griswold | 30/169 |
| 2,259,699 | 10/1941 | Larson | 15/245 |
| 2,319,355 | 5/1943 | Storey | 15/245 |
| 2,526,991 | 10/1950 | Biddle | 15/236 R |
| 2,880,505 | 4/1959 | Gerry | 30/169 |
| 4,481,690 | 11/1984 | Simmons | 30/169 |
| 4,521,934 | 6/1985 | Castle | 15/236 A |

*Primary Examiner*—Werner H. Schroeder
*Assistant Examiner*—Mary A. Ellis
*Attorney, Agent, or Firm*—William W. Haefliger

[57] ABSTRACT

A lottery ticket processor accepts a sequence of lottery tickets between two plates, each ticket presenting its number zone at a plate window; and a scraper, which may be carried by the processor body, has an edge to be received in the window to quickly scrape away all the film overlying the number on a ticket.

16 Claims, 7 Drawing Figures

LOTTERY TICKET PROCESSOR

BACKGROUND OF THE INVENTION

This invention relates generally to ticket processing by the ticket buyer, and more particularly to a handy, easily usable device for quickly and accurately processing a sequence of lottery tickets, to reveal concealed alphanumeric characters such as numbers.

Lottery ticket buyers commonly buy a string or strip of tickets, and are then faced with the problem of slowly removing the film on each ticket, as by means of slow manipulation of coin rounded edges to scrape off the film on the tickets. This may damage one or more of the numbers on the ticket substrates, and becomes a laborious task when a large number of strung together tickets are to be processed. There is need for a device to greatly reduce such labor, and to enable quick removal of the film on the interconnected tickets (or even on one ticket).

SUMMARY OF THE INVENTION

It is a major object of the invention to provide a device meeting the above need. Basically, the device of the invention comprises:

(a) a body having upper and lower flat, generally parallel, laterally extending plates which extend in proximity to define a space therebetween, the plates and said space sized to slidably pass the string of tickets, in sequence, longitudinally between the plates and so that at least one fold lines up with a plate edge as a ticket is received in said space, (b) a window in the upper plate, to register with a zone of a ticket in said space, and via which alphanumeric characters on the ticket are presented, upon removal of an overlying film at said zone, (c) and a scraper carried by said body for scraping off said film on said zone of the ticket at said space, when a portion of the scraper is inserted through said window.

As will appear, the plates are typically interconnected to allow manual displacement of at least one plate toward the other to pinch and hold the ticket in said space during removal of said film by said scraper; and also to define a gap via which a portion of the scraper may be inserted endwise into the space between said plate, for storage. The scraper is typically flat and has a blade defining a scraping edge, and a part to be manually grasped, the blade edge having a width substantially the same as the width of said window. The scraper may also have a head to be manually grasped for manipulating said blade, the head wider than the blade to define stop means engaging with an edge on the body for limiting insertion of the blade into said space, via said gap. The head may be generally semicircular to eliminate corner presentation; and it may have an auxiliary scraping edge of width less than the blade on the stem so that a selected film area corresponding to a film covered alphanumeric character or character group may be scraped and removed by said auxiliary edge, via said window.

These and other objects and advantages of the invention, as well as the details of an illustrative embodiment, will be more fully understood from the following specification and drawings, in which:

DRAWING DESCRIPTION

DETAILED DESCRIPTION

Figure 1:
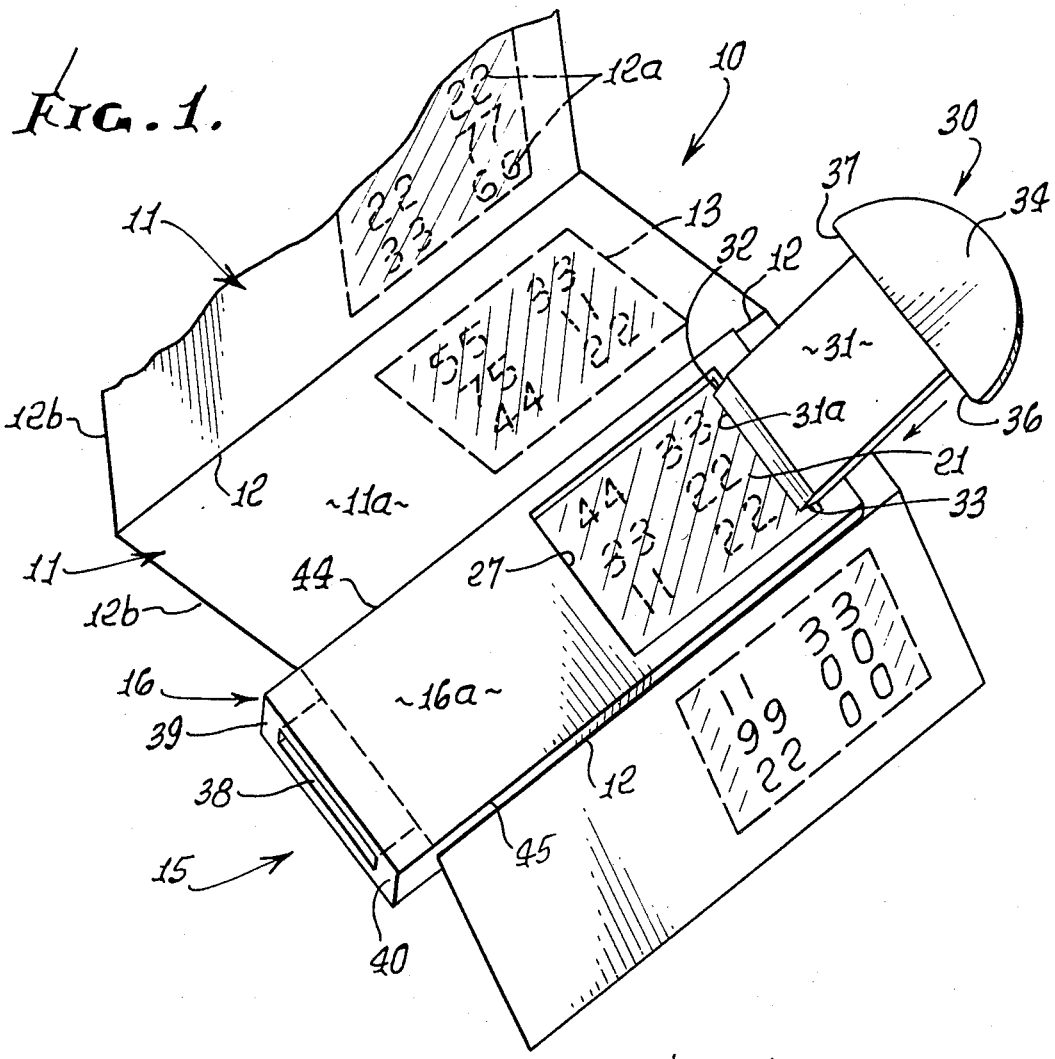
FIG. 1 is a perspective view of a processor processing a sequence of lottery tickets.

FIG. 1 shows a strip 10 of lottery tickets 11, each of which is rectangular and is laterally elongated. The tickets are connected along lateral folds 12, and each ticket 11 includes a stiff paper or other substrate **11*a*. Alphanumberic characters, such as numbers indicated at 12*a*, are printed on otherwise affixed to the ticket in a rectangular zone 13**, and a film or mask is affixed over the numbers to conceal them. Previously a coin was used by the ticket buyer to scratch off the film so as to reveal the concealed numbers. This was laborious and time consuming. The film may consist of thin foil.

In accordance with the invention, the processor 15 is provided to enable rapid processing of the strip or string of tickets, one by one, greatly reducing the time and difficulty of removing the film for ascertaining the concealed numbers.

Figure 3:
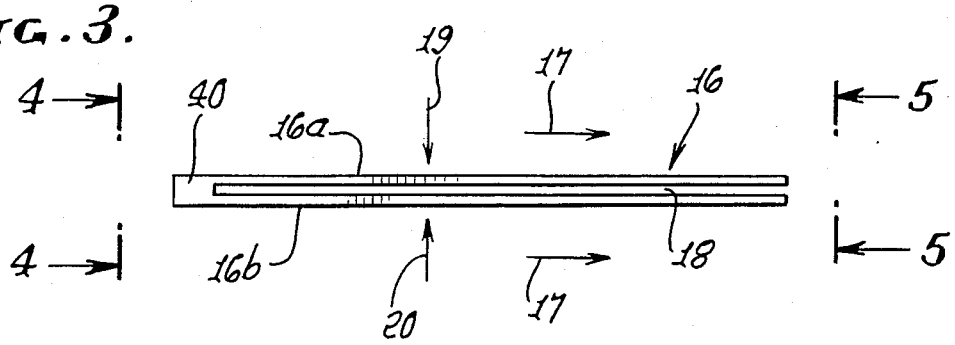
FIG. 3 is an edge elevational view of the processor body.
Figure 4:
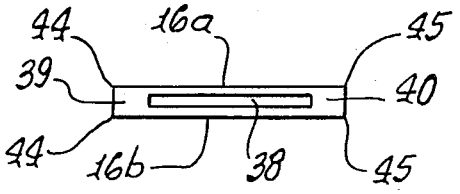
FIG. 4 is a left end elevation taken on lines 4—4 of FIG. 3.
Figure 5:
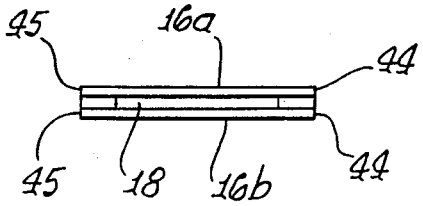
FIG. 5 is a right end elevation taken on lines 5—5 of FIG. 3.

The processor 15 includes a body 16 having upper and lower thin, flat plates **16*a* and 16*b* (metal, plastic, or other material), which extend or are elongated generally laterally, (see arrows 17), to define a thin space 18 therebetween. The thickness of that space is typically slightly greater than the thickness of the ticket so as to enable frictional sliding of the tickets longitudinally between the plates, while enabling slight finger pressure or squeezing (see arrows 19 and 20 in FIG. 3) of the plates to grip the selected ticket being processed between the plate, so as to enable quick scrape removal of the film 21 over the concealed numbers. At the time, the lateral folds 12 at opposite edges of the selected ticket received in space 18 line-up or register, or approximately register, with the laterally extending opposite edges 44 and 45 of the superposed, like-sized plates 16*a* and 16*b***.

A window 40 through the upper plate **16*a* then registers with the zone 13 of the selected ticket in space 18, so that the concealed alphanumeric characters or numbers are presented (beneath film 21), and the film is presented for access through the window for scrape-removal. The rectangular window is bounded by laterally extending guide edges 24 and 25 about 29/32 inch in length, and endwise laterally space stop edges 26 and 27**, about 1½ inches in length, to provide accurate guiding of the scraper to be described, for quick film removal.

A scraper 30 is provided to be carried by the body 16, in a storage position (see FIG. 2), and alternatively to be quickly removed from storage and to be employed for quickly scraping off the film 21 when a portion, such as edge **31*a* of blade 31 of the scraper, is inserted through the window (see FIG. 1), and pressed against the film while the scraper edge is displaced from a position near window stop edge 26 toward window stop-edge 27**.

During this movement, window guide edges 24 and 25 may guide th blade edges 32 and 33. The flat scraper also includes a head 34 in the same plane as blade 31, and which is easily manually graspable for manipulating the scraper as described.

The head is typically wider than the blade to define stop means such as edge stops 36 and 37 engagable with an end edge or edges 38 on the body 16 for limiting storage insertion of the blade 31 into space 18. Such insertion is facilitated via a guide gap 38 of narrower width than the plate, but of about the width of the blade 31. Gap 38 is defined between two corner connections 39 and 40 which connect the two plate 16*a* and 16*b*.

Thus, connections 39 and 40 have the multiple functions of integrating the plates into a single body; defining guide gap 38; limiting insertion of the blade 31 into space 18 by engagement with head stops 36 and 37; and connecting the plates in cantilever relation, so that tickets can be inserted into the space 18 and project freely from open end 18*a* of that space; allowing pinching of the plates near the window to grip the ticket during film removal; and acting as stops and guides by engaging edges 12*b* of the tickets as they are slid longitudinally through the processor, so that zones 13 quickly line-up or register with window 40 in the top plate.

Figure 2:
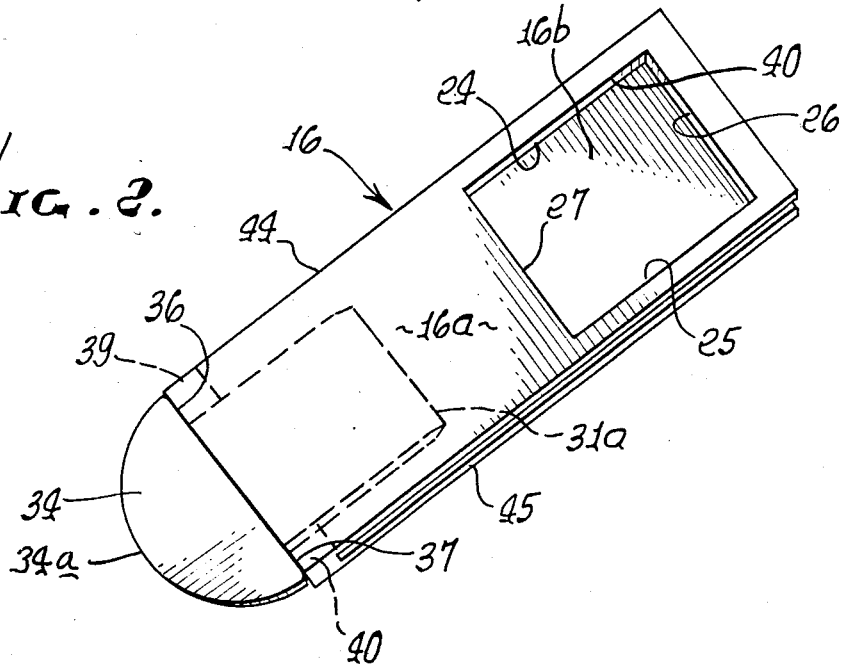
FIG. 2 is a perspective view of the processor with a scraper stored at one end of the processor.
Figure 6:
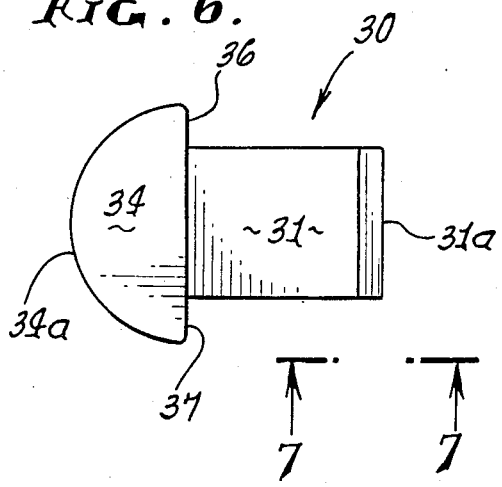
FIG. 6 is a plan view of the scraper.

In FIGS. 1, 2 and 6 the head 34 has a semicircular edge 34*a*, for easy grasping and to eliminate corner exposure during storage (to prevent tearing of the user's pockets or purse). That edge may be employed as an auxiliary scraping edge, if desired.

The two corner connections 39 and 40 preferably each have about one quarter inch width, i.e. along the width dimension of gap 38; and the gap thickness is about 0.060 inch which is about the thickness of blade 31, for frictional retention of the blade in stored position between the plates.

Figure 7:
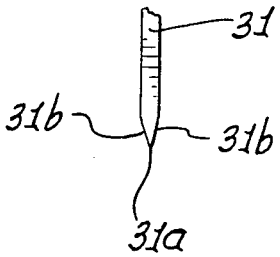
FIG. 7 is a view on lines 7—7 of FIG. 6.

FIG. 7 shows the tapered side portions 31*b* of the blade 31, terminating at edge 31*a*. The scraper overall length is preferably about 2¼ inches, and the overall width of head 34 is prefereably about 1½ inches.

We claim:

1. In a device for processing a string of lottery tickets interconnected along laterally extending folds, each ticket being rectangular, the combination comprising:

(a) a body having upper and lower flat, generally parallel, laterally extending plates which extend in proximity to define a space therebetween, the plate and said spaced sized to slidably pass the string of tickets, in sequence, longitudinally between the plates and so that at least one fold lines up with a plate edge as a ticket is received into said space, (b) a window in the upper plate to register with a zone of a ticket in said space, and via which alphanumberic characters on the ticket are presented, upon removal of an overlying film at said zone, (c) and a scraper carried by said body for scraping off said film on said zone of the ticket at said space, when a portion of the scraper is inserted through said window.

2. The device of claim 1 wherein said plates are interconnected to allow manual displacement of at least one plate toward the other to pinch and hold the ticket in said space during removal of said film by said scraper.

3. The device of claim 1 wherein said plates are interconnected at spaced locations to define a gap via which a portion of the scraper may be inserted endwise into the space between said plates for storage.

4. The device of claim 1 wherein said scraper is flat and has a blade defining a scraping edge, and a head to be manually grasped, the blade edge having a width substantially the same as the width of said window.

5. The device of claim 3 wherein said scraper is flat and has a blade defining a scraping edge, the blade and said edge having width substantially the same as the width of said gap.

6. The device of claim 5 wherein the scraper has a head to be manually grasped for manipulating said blade, the head wider than the blade to define stop means engaging with an edge on the body for limiting insertion of the blade into said space, via said gap.

7. The device of claim 1 wherein the window has width of about 29/32 inch.

8. The device of claim 4 wherein the window has length of about 1½ inches.

9. The device of claim 4 wherein the head of said scraper is generally semicircular.

10. The device of claim 4 wherein the head defines an auxiliary scraping edge of width less than the blade on the scraper so that a selected film area corresponding to a film covered alphanumeric character means may be scraped and removed by said auxiliary edge, via said window.

11. The device of claim 1 wherein the body includes local corner connections between the plates presented to engage ticket edges as the tickets are slid between the plates thereby to aid in effecting presentation of said zones in said window, and to allow squeezing of the plates to grip a ticket therebetween.

12. The device of claim 5 wherein the blade is tapered toward said scraping edge, and proximate said edge.

13. For use in a device for processing a string of lottery tickets interconnected along laterally extending folds, each ticket being rectangular, the device including (a) a body having upper and lower flat, generally parallel, laterally extending plates which extend in proximity to define a space therebetween, the plate and said space sized to slidably pass the string of tickets, in sequence, longitudinally between the plates and so that at least one fold lines up with a plate edge as a ticket is received into said space, and (b) a window in the upper plate to register with a zone of a ticket in said space, and via which alphanumeric characters on the ticket are presented, upon removal of an overlying film at said zone, the improvement comprising (c) a scraper carried by said body for scraping of said film on said zone of the ticket at said space, when a portion of the scraper is inserted through said window (d) the scraper being flat and having a blade defining a scraping edge, and a head to be manually grasped, the blade edge having a width substantially the same as the width of said window.

14. The improvement of claim 13 wherein the blade has a width of about 29/32 inch.

15. The improvement of claim 13 wherein the head is enlarged to be manually grasped for manipulating said blade, the head wider than the blade to define stop means for engaging an edge of the body.

16. The improvment of claim 15 wherein the head overall width is about 1½ inches, and the scraper overall length is about 2¼ inches.

* * * * *